US005860836A

United States Patent [19]

Ohno

[11] Patent Number: 5,860,836

[45] Date of Patent: Jan. 19, 1999

[54] CONTACT WHICH ENABLES RELIABLE DISCRIMINATION OF ITS ORIENTATION AND CONNECTOR USING THE SAME

[75] Inventor: Akira Ohno, Tokyo, Japan

[73] Assignee: Japan Aviation Electronics Industry, Limited, Tokyo, Japan

[21] Appl. No.: 840,502

[22] Filed: Apr. 21, 1997

[30] Foreign Application Priority Data

Apr. 26, 1996 [JP] Japan ..... 108253

[51] Int. Cl.[6] ..... H01R 11/22

[52] U.S. Cl. ..... 439/752.5; 439/852

[58] Field of Search ..... 439/595, 752.5, 439/733.1, 851, 852, 677–680

[56] References Cited

U.S. PATENT DOCUMENTS 3,104,927 9/1963 Cargill et al. ..... 439/852

5,624,273 4/1997 Myer ..... 439/409 X 5,658,173 8/1997 Genta ..... 439/752.5

*Primary Examiner*—Khiem Nguyen

*Attorney, Agent, or Firm*—Laff, Whitesel, Conte & Saret, Ltd.

[57] ABSTRACT

In a contact in which a cylindrical member (12) surrounds an elastic contact piece (11) to be brought into contact with a mating contact, the cylindrical member has first and second portions (12*a*, 12*b*) which are different from each other in width thereof throughout an axial length of the cylindrical member. The first portion defines a receiving space (13) located adjacent to the elastic contact piece in a radial direction to receive the mating contact piece. The second portion corresponds to the elastic contact piece.

4 Claims, 8 Drawing Sheets

CONTACT WHICH ENABLES RELIABLE DISCRIMINATION OF ITS ORIENTATION AND CONNECTOR USING THE SAME

BACKGROUND OF THE INVENTION

This invention relates to a contact and a connector comprising the contact held in an insulator or a housing.

A conventional contact for use in a connector comprises an elastic contact piece to be brought into contact with a mating contact and a cylindrical member surrounding the elastic contact piece and defining a receiving space to receive the mating contact. The cylindrical member is inserted into a contact insertion space formed in the insulator. When the contact is inserted into the contact insertion space, a protrusion formed on a part of the cylindrical member in an axial direction is engaged with the insulator. Thus, the orientation of the contact is discriminated by presence of the protrusion.

However, since the conventional contact described above has the protrusion formed as an additional component, the outer dimension of the whole contact inevitably becomes large. In other words, it is difficult to miniaturize the contact. Furthermore, the cylindrical member can be inserted into the insulator insertion space even in a wrong orientation until the protrusion is engaged with the insulator. Under the circumstances, it is difficult to discriminate the orientation.

SUMMARY OF THE INVENTION

It is therefore an object of this invention to provide a contact which enables discrimination of its orientation without increasing the outer dimension of the whole contact.

It is another object of this invention to provide a contact of the type mentioned above which enables discrimination of its orientation with obviousness.

It is still another object of this invention to provide a contact of the type mentioned above which has a less possibility of damaging an insulator and an electric wire when the contact is fitted into the insulator or otherwise handled.

It is yet another object of this invention to provide a contact of the type mentioned above which can be easily miniaturized.

It is a further object of this invention to provide a connector using the above-described contact.

Other objects of this invention will become clear as the description proceeds.

According to this invention, there is provided a contact comprising an elastic contact piece to be brought into contact with a mating contact, and a cylindrical member surrounding the elastic contact piece and defining a receiving space located adjacent to the elastic contact piece in a radial direction to receive the mating contact piece. In the contact, the cylindrical member has a first portion defining the receiving space and having a first width and a second portion corresponding to the elastic contact piece and having a second width. The first and the second widths are different from each other throughout an axial length of the cylindrical member.

According to this invention, there is also provided a connector comprising an insulator having a contact insertion space, and a contact inserted into the contact insertion space and engaged with the insulator to be positioned in a predetermined orientation. In the connector, the contact comprises an elastic contact piece to be brought into contact with a mating contact, and a cylindrical member surrounding the elastic contact piece and defining a receiving space located adjacent to the elastic contact piece in a radial direction to receive the mating contact piece. The cylindrical member has a first portion defining the receiving space and having a first width and a second portion corresponding to the elastic contact piece and having a second width. The first and the second widths are different from each other throughout an axial length of the cylindrical member.

DESCRIPTION OF THE PREFERRED EMBODIMENT

For the better understanding of this invention, description will at first be made as regards various conventional contacts.

Figure 1:
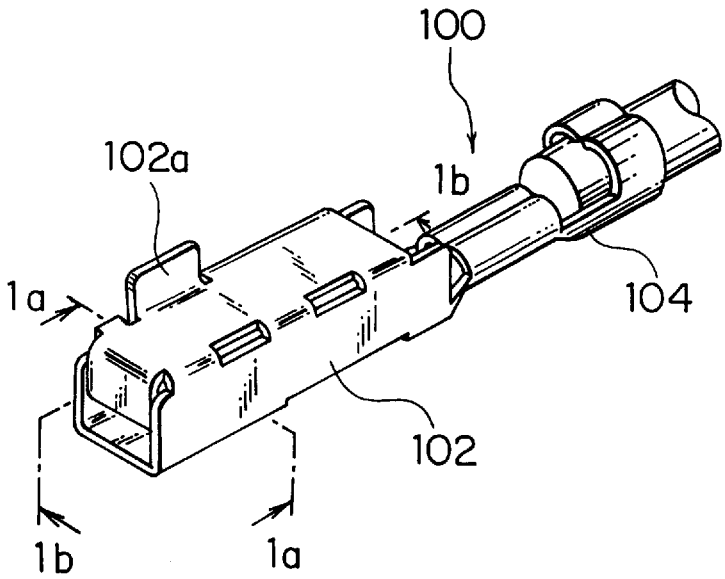
FIG. 1 (PRIOR ART)
FIG. 1 is a perspective view of a first conventional contact.

Referring to FIG. 1, a conventional contact 100 is to be inserted into and held in a contact insertion space formed in an insulator (not shown). The contact 100 comprises a cylindrical member 102 and a wire coupling portion 104 extending from the cylindrical member 102. The cylindrical member 102 is made of a metal plate. The cylindrical member 102 is provided on its upper surface with a protrusion 102*a* formed by protruding a part of the metal plate upward.

Figure 1A:
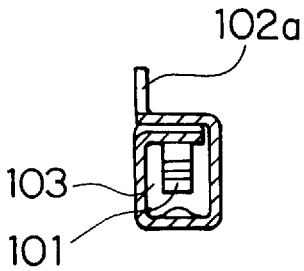
FIG. 1A is a sectional view taken along a line 1*a*—1*a* in FIG. 1.
Figure 1B:
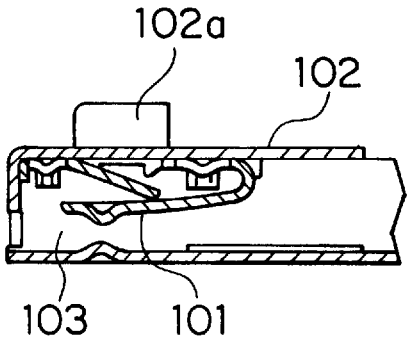
FIG. 1B is a sectional view taken along a line 1*b*—1*b* in FIG. 1.

Referring to FIGS. 1A and 1B, the cylindrical member 102 defines a receiving space 103 for receiving a mating contact which is not shown in the figure. Within the cylindrical member 102, an elastic contact piece 101 to be brought into elastic contact with the mating contact is arranged.

Since the protrusion 102*a* is formed at a particular position of the cylindrical member 102, an operator can discriminate the orientation of the contact 100 when the contact 100 is fitted into the insulator.

However, since the protrusion 102*a* is formed as an additional component, the outer dimension of the whole contact 100 inevitably becomes large. It is therefore difficult to miniaturize the contact 100. In addition, the protrusion 102*a* is liable to damage the other components. Furthermore, the protrusion 102*a* of a flat plate shape is easily deformed.

Figure 2:
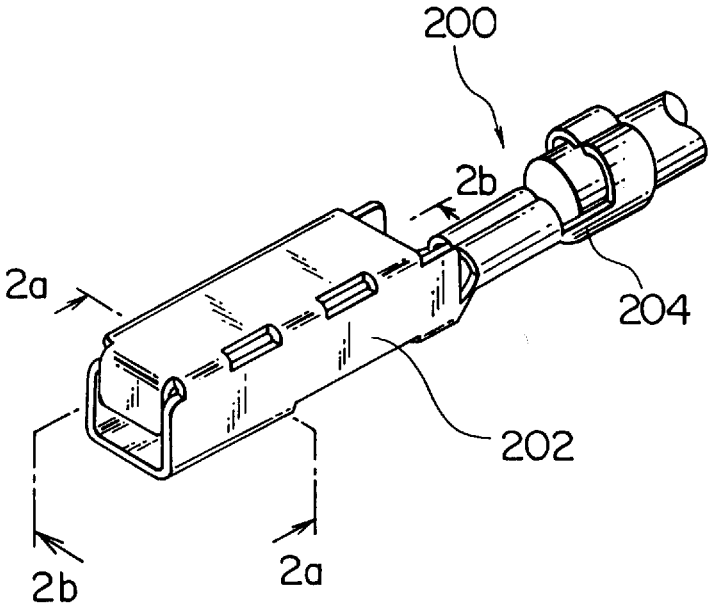
FIG. 2 (PRIOR ART)
FIG. 2 is a perspective view of a second conventional contact.

Referring to FIG. 2, a second conventional contact 200 comprises a cylindrical member 202 and a wire coupling portion 204 extending from the cylindrical member 202.

Figure 2A:
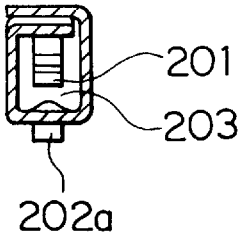
FIG. 2A is a sectional view taken along a line 2*a*—2*a* in FIG. 2.
Figure 2B:
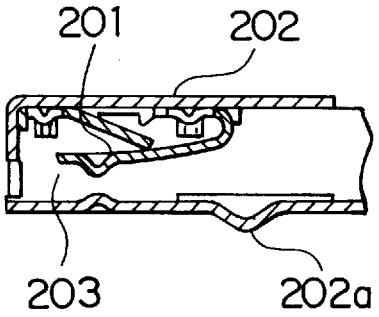
FIG. 2B is a sectional view taken along a line 2*b*—2*b* in FIG. 2.

As illustrated in FIGS. 2A and 2B, the cylindrical member 202 is made of a metal plate. The cylindrical member 202 is provided on its lower surface with a protrusion 202*a* formed by bending a part of the metal plate to protrude the part downward. The cylindrical member 202 defines a receiving space 203 for receiving a mating contact which is not shown in the figure. Within the cylindrical member 202, an elastic contact piece 201 to be brought into elastic contact with the mating contact is arranged.

Since the protrusion 202*a* is formed at a particular position of the cylindrical member 202, an operator can discriminate the orientation of the contact 200 when the contact 200 is fitted into the insulator.

However, since the protrusion 202*a* is formed as an additional component, the outer dimension of the whole contact 200 inevitably becomes large. It is therefore difficult to miniaturize the contact 200. In addition, the protrusion 202*a* is liable to damage the other components.

Figure 3:
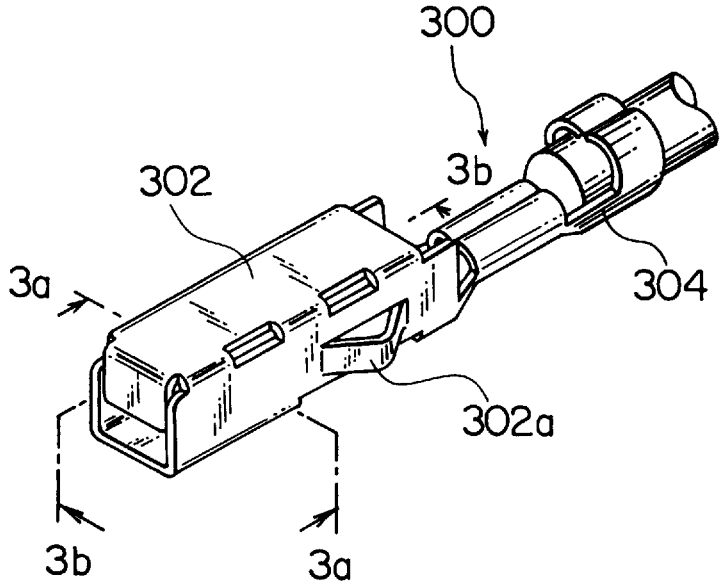
FIG. 3 (PRIOR ART)
FIG. 3 is a perspective view of a third conventional contact.

Referring to FIG. 3, a third conventional contact 300 comprises a cylindrical member 302 and a wire coupling portion 304 extending from the cylindrical member 304. The cylindrical member 302 is made of a metal plate. The cylindrical member 302 is provided on its side surface with a protrusion 302*a* formed by bending a part of the metal plate to protrude the part sideward.

Figure 3A:
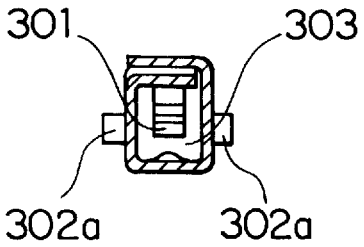
FIG. 3A is a sectional view taken along a line 3*a*—3*a* in FIG. 3.
Figure 3B:
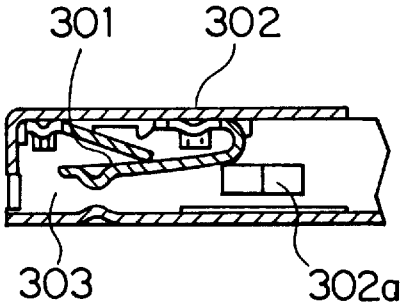
FIG. 3B is a sectional view taken along a line 3*b*—3*b* in FIG. 3.
Figure 4:
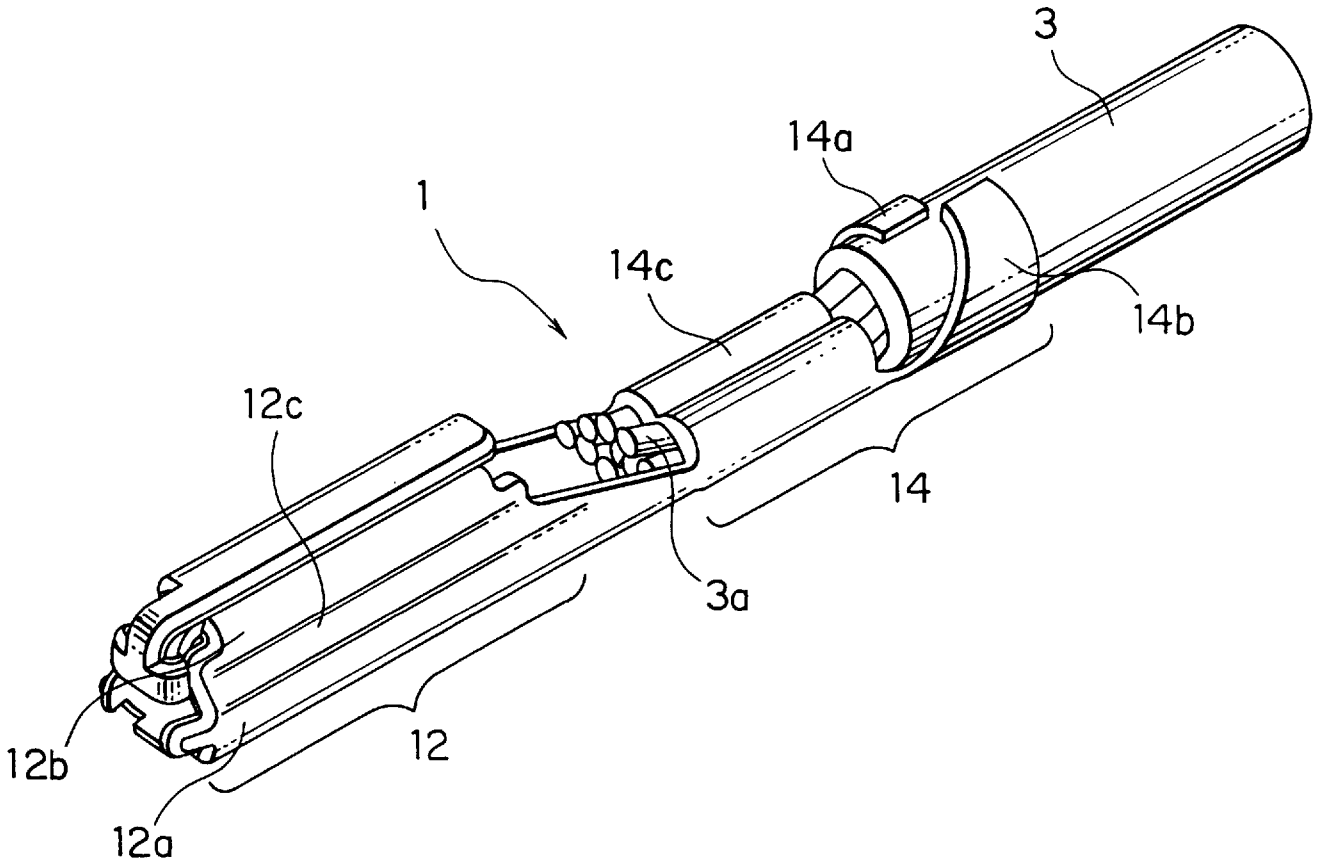
FIG. 4 is a perspective view of a contact according to an embodiment of this invention with an electric wire connected thereto.
Figure 4B:
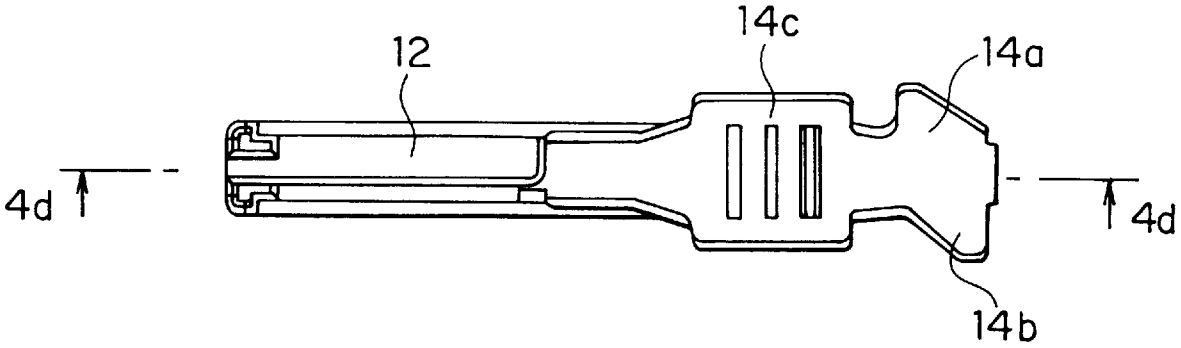
FIG. 4B is a plan view of the contact illustrated in FIG. 4.
Figure 4A:
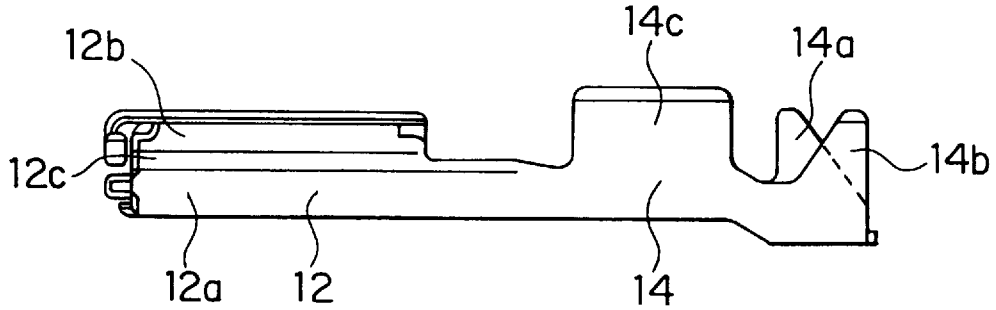
FIG. 4A is a front view of the contact illustrated in FIG. 4.
Figure 4C:
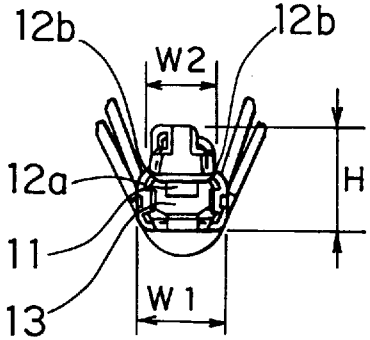
FIG. 4C is a left side view of the contact illustrated in FIG. 4.
Figure 4D:
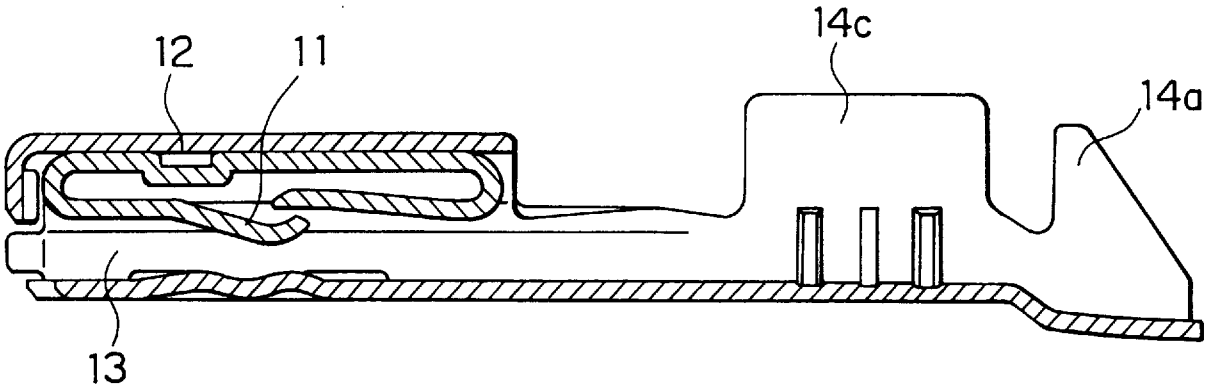
FIG. 4D is a sectional view taken along a line 4*d*—4*d* in FIG. 4B.
Figure 5:
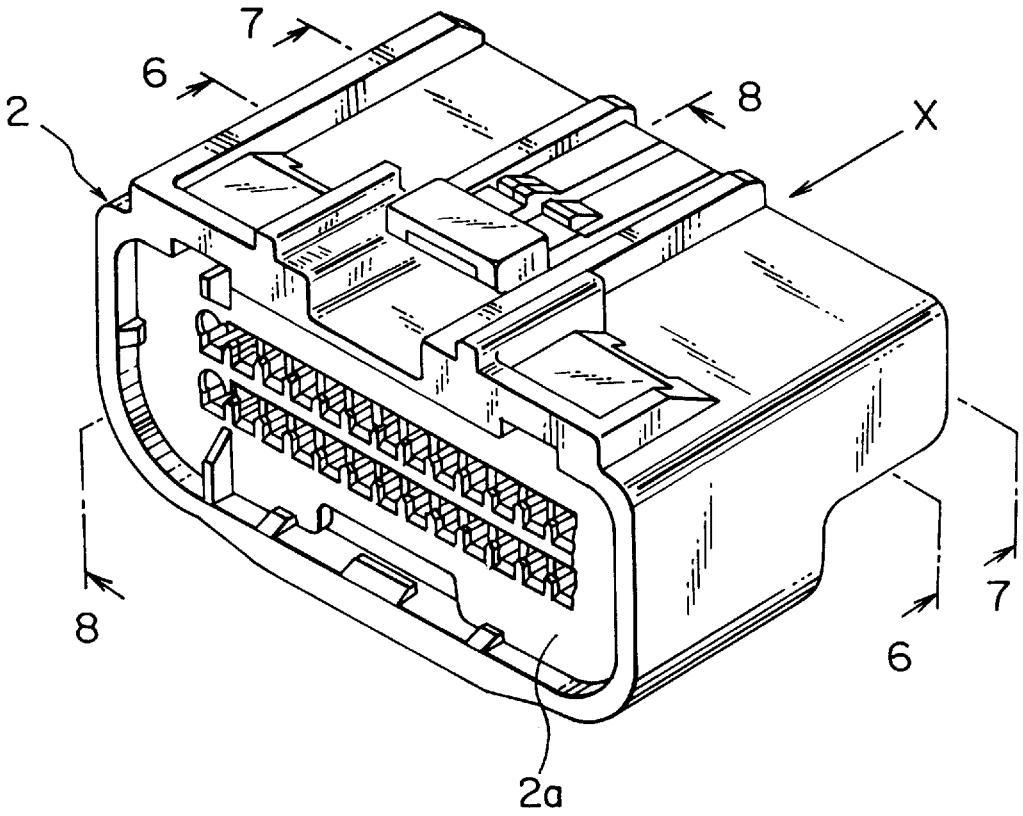
FIG. 5 is a perspective view of an insulator for holding the contact illustrated in FIG. 4.

As illustrated in FIGS. 3A and 3B, the cylindrical member 302 defines a receiving space 303 for receiving a mating contact which is not shown in the figure. Within the cylindrical member 302, an elastic contact piece 301 to be brought into elastic contact with the mating contact is arranged.

Since the protrude 302*a* is formed at a particular position of the cylindrical member 302, an operator can discriminate the orientation of the contact 300 when the contact 300 is fitted into the insulator.

However, since the protrusion 302*a* is formed as an additional component, the outer dimension of the whole contact 300 inevitably becomes large. It is therefore difficult to miniaturize the contact 300. In addition, the protrusion 302*a* is liable to damage the other components.

Next, the description will be made as regards an embodiment of this invention.

Referring to FIGS. 4, 4A, 4B, 4C, and 4D, a contact 1 comprises a cylindrical member 12 and a wire coupling portion 14 extending from the cylindrical member 12. The cylindrical member 12 is made of a metal plate and has a first or lower portion 12*a* and a second or upper portion 12*b*. The lower portion 12*a* defines a receiving space 13. Within the upper portion 12*b* of the cylindrical member 12, an elastic contact piece 11 extends from the cylindrical member 12 and partly faces the receiveing space 13 in a radial direction of the contact. The elastic contact piece 11 is for being brought into elastic contact with a mating contact which is not shown in the figure.

The wire coupling portion 14 has a pair of coupling pieces 14*a* and 14*b* and a connecting piece 14*c*. When no wire is coupled, the coupling pieces 14*a* and 14*b* are spaced from each other and opened. In order to hold a sheathed wire 3 by the contact 1, a portion of the sheathed wire 3 which is slightly apart from its top end is placed between the coupling pieces 14*a* and 14*b*. Then, the coupling pieces 14*a* and 14*b* are closed. The top end of the sheathed wire 3 is unsheathed and caulked by the connecting piece 14*c* so that the sheathed wire 3 is electrically connected to the contact 1.

The lower portion 12*a* of the cylindrical member 12 has a first width W1. The upper portion 12*b* of the cylindrical member 12 has a second width W2. The first width W1 is selected to be greater than the second width W2. Accordingly, the cylindrical member 12 has a cross section of a generally convex shape. The first width W1 is determined by the width of the receiving space 13 and the thickness of the contact 1. The second width W2 is determined by the width of the elastic contact piece 11 and the thickness of the contact 1. The height H of the cylindrical member 12 is determined by the thickness of the elastic contact piece 11, the height of the receiving space 13, and the thickness of the contact 1.

A boundary portion between the lower portion 12*a* and the upper portion 12*b* of the cylindrical member 12 corresponds to the elastic contact piece 11. The boundary portion is curved to form a curved portion 12*c*. The curved portion 12*c* extends in an axial direction of the contact 1 throughout the cylindrical member 12. In other words, the cross section of the cylindrical member 12 has a generally convex shape or a mesa shape which is invariable and continuous throughout the axial length of the cylindrical member 12. This means that the contact 1 has an orientation discrimination function throughout the substantially entire length of the cylindrical member 12.

The width of each of the elastic contact piece 11 and the receiving space 13 is appropriately determined as required in view of the performance.

In the above-described contact 1, the difference between the first and the second widths of the cylindrical member 12 can be relatively small. It is therefore possible to reduce the maximum outer dimension of the contact 1. Since the cross section of the cylindrical member 12 is invariable in shape throughout the entire axial length, the contact 1 is prevented from damaging other components.

Next, referring to FIGS. 5 through 8, description will be made as regards an insulator 2 for holding the above-described contact 1. The insulator 2 is made of plastic and has a large number of contact insertion spaces 21 arranged in upper and lower two rows. The contact 1 is inserted into each of the contact insertion spaces 21 through a front surface 2*a* of the insulator 2 with the cylindrical member 12 directed forward.

Figure 6:
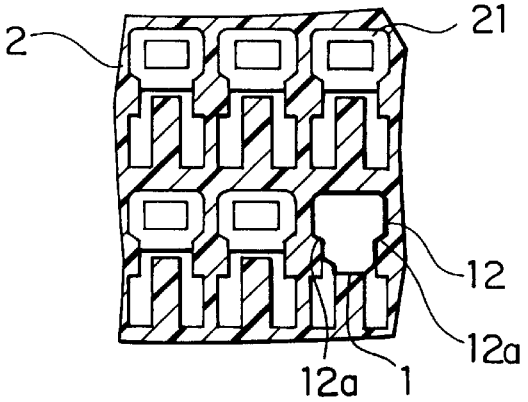
FIG. 6 is a partial sectional view taken along a line 6—6 in FIG. 5.
Figure 7:
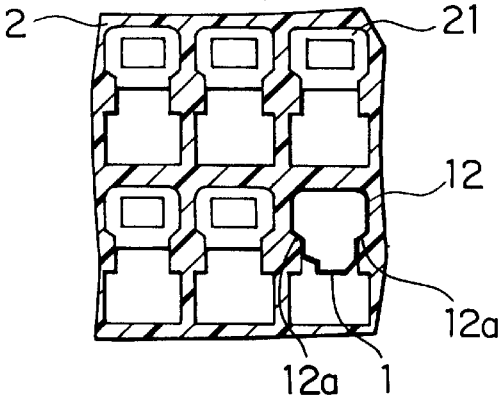
FIG. 7 is a partial sectional view taken along a line 7—7 in FIG. 5.
Figure 8:
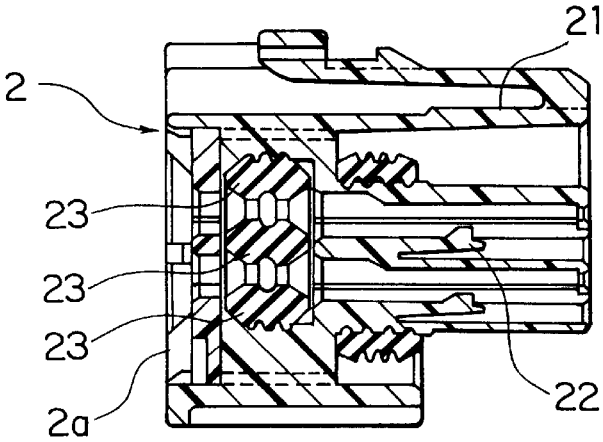
FIG. 8 is a sectional view taken along a line 8—8 in FIG. 8.

In FIGS. 6 and 7, the contact 1 is inserted into only one of the contact insertion spaces 21 and simply depicted by a contour line thereof. From these figures, it will be understood that the contact 1 is positioned and oriented within the insulator 2 by engagement between the curved portion 12*c* of the cylindrical member 12 of the contact 1 and the insulator 2.

When the contact 1 is inserted into the contact insertion space 21, an operator can discriminate the orientation of the contact 1 because the cylindrical member 12 has a cross section of a generally convex shape. After insertion, the contact 1 is locked by a locking protrusion 22 corresponding to the contact insertion space 21 and is therefore prevented from being released from the contact insertion space 21. An elastic insulating member 23, such as rubber, is inserted into the insulator 2.

While the present invention has thus far been described in connection with a single embodiment thereof, it will readily be possible for those skilled in the art to put this invention into practice in various other manners. For example, the width of the upper portion may be greater than that of the lower portion, although the width of the lower portion of the cylindrical member is greater than that of the upper portion in the foregoing description.

What is claimed is:

1. A contact comprising:

an elastic contact piece to be brought into contact with a mating contact; and a cylindrical member surrounding said elastic contact piece and defining a receiving space located adjacent to said elastic contact piece in a radial direction to receive said mating contact piece, said cylindrical member having a first portion defining said receiving space and having a first width and a second portion corresponding to said elastic contact piece and having second a width, said first width being greater than said second width, said first and said second widths being different from each other throughout an axial length of said cylindrical member, and said cylindrical member having a curved portion connecting said first and said second portions to each other, said curved portion having a substantially same cross sectional shape throughout an axial length of said cylindrical member, wherein said cross sectional shape of cylindrical member is a mesa shape throughout an axial length of said cylindrical member.

2. A contact as claimed in claim 1, wherein said elastic contact piece inwardly extends from said cylindrical member to face said receiving space.

3. A connector comprising:

an insulator having a contact insertion space; and a contact inserted into said contact insertion space and engaged with said insulator to be positioned in a predetermined orientation;

said contact comprising:

an elastic contact piece to be brought into contact with a mating contact; and a cylindrical member surrounding said elastic contact piece and defining a receiving space located adjacent to said elastic contact piece in a radial direction to receive said mating contact piece, said cylindrical member having a first portion defining said receiving space and have a first width and a second portion corresponding to said elastic contact piece and having a second width, said first width being greater than said second width, said first and said second widths being different from each other throughout an axial length of said cylindrical member; and wherein said cross sectional shape of the cylindrical member is a mesa shape throughout an axial length of said cylindrical member.

4. A connector as claimed in claim 3, wherein said elastic contact piece inwardly extends from said cylindrical member to face said receiving space.

* * * * *